United States Patent [19]

Dinsmore, Jr.

[11] 3,986,366

[45] Oct. 19, 1976

[54] HEDGEHOG ANCHOR

[75] Inventor: Daniel Dinsmore, Jr., East Lyme, Conn.

[73] Assignee: The United States of America as represented by the Secretary of the Navy, Washington, D.C.

[22] Filed: Sept. 22, 1975

[21] Appl. No.: 615,313

[52] U.S. Cl. ..... 61/39; 61/45 B; 61/53; 52/155

[51] Int. Cl.[2] ..... E02D 5/80; E02D 5/74

[58] Field of Search ..... 61/53.68, 53.5, 53, 61/39, 45 B, 35; 52/155, 162, 163

[56] References Cited

UNITED STATES PATENTS

| | | | |
|---|---|---|---|
| 756,640 | 4/1904 | Ivons | 52/162 X |
| 1,308,940 | 7/1919 | Eggleston | 52/155 |
| 1,731,645 | 10/1929 | Williams | 52/155 X |
| 2,675,568 | 4/1954 | King | 43/25 X |
| 2,858,917 | 11/1958 | Wendt | 52/162 |
| 3,324,666 | 6/1967 | Lee | 52/155 X |
| 3,924,371 | 12/1975 | Kidwell | 52/162 X |

FOREIGN PATENTS OR APPLICATIONS

| | | | |
|---|---|---|---|
| 1,565,373 | 3/1969 | France | 24/DIG. 30 |

*Primary Examiner*—Dennis L. Taylor

*Attorney, Agent, or Firm*—Richard S. Sciascia; Arthur A. McGill; Prithvi C. Lall

[57] ABSTRACT

An anchoring device suitable for restraining line arrays comprises a cylinder having a plurality of spring loaded flukes spaced both axially and radially from each other. The flukes retract flush into slots in the cylinder so that the anchoring device may be ejected from a submarine through a stuffing tube gland. The flukes until ejected are held in the retracted position by means of a caked water soluble material. A plurality of anchors may be ganged together by means of a coupling assembly. The same coupling assembly is suitable for connecting the anchoring device to the line arrays.

1 Claim, 4 Drawing Figures

HEDGEHOG ANCHOR

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION

The present invention generally relates to anchors and more particularly to an anchoring device suitable for restraining lines arrays having either acoustic, environmental or mechanical sensors, or a combination thereof, on the ocean floor to maintain a fixed position. The device is particularly adapted to be deployed from a submarine.

The inventive device is suitable for use with reduced diameter line type arrays of flexible tube construction. One version of the reduced diameter array is for a fixed installation that is deployable from a submarine. Since the array is of small diameter, it is to be carried inside the submarine and implanted by ejection through a floating wire antenna launching device. This invention addresses itself to solving the requirements of an anchoring device for an array with both the anchoring device and array carried inside the submarine and ejected through the antenna launcher. Without this invention, the array must be carried on the outside of the submarine with the obvious disadvantages of requiring remote launching and pay-out devices and protective super-structure for the array while stored in transit to the implantment site. Also, it appears only one array could be carried external to the submarine.

SUMMARY OF THE INVENTION

Accordingly, it is a general purpose and object of the present invention to provide an improved anchoring device. It is a further object that the device be deployable from inside a submarine. Another object is that the diameter prior to deployment be sufficiently small. An additional object is that the length of the device be variable by adding sections. Further objects are that the device be low in cost, high in reliability and suitable for ease in storage prior to deployment. These and other objects of the invention and the various features and details of construction and operation will become apparent from the specification and drawings.

This is accomplished in accordance with the present invention by providing an apparatus having a cylindrical housing. A section of housing having a plurality of flukes radially and axially spaced from each other have the flukes released upon the apparatus being submerged in water. Additional sections can be added depending upon the anchoring strength required. Prior to deployment the flukes are held flush with the sidewalls of the housing for ease in both storage and deployment. The ejection of the apparatus is through the hull in the antenna launcher.

DESCRIPTION OF THE PREFERRED EMBODIMENT

Figure 1:
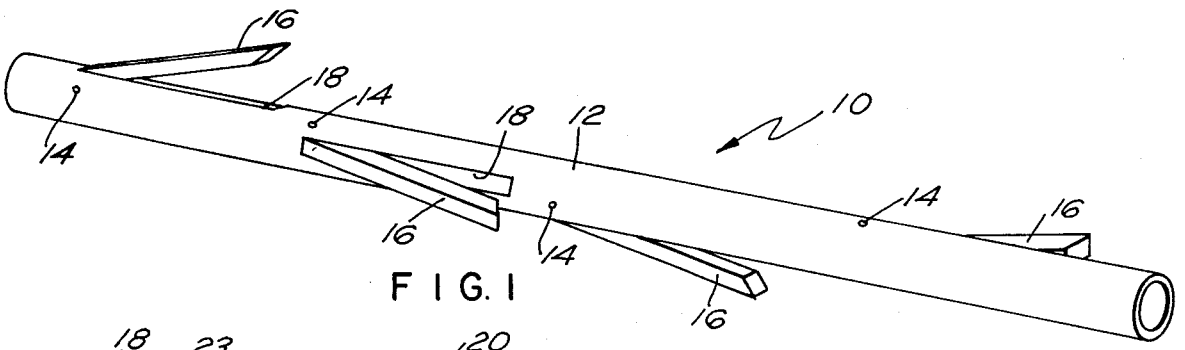
FIG. 1 shows a hedgehog anchor section in accordance with the present invention.

Referring now to FIG. 1 there is shown a hedgehog anchor section 10 in a deployed position. The section 10 comprises a hollow cylinder 12 with a plurality of hinges 14 affixed to cylinder 12. The hinges 14 shown are metal rods and can be affixed to cylinder 12 in any of various well known ways. A plurality of flukes 16 rotate on respective hinges 14.

The flukes 16 are located in progressively rotated positions on cylinder 12, so that when the flukes 16 are extended from slots 18 and the anchor 10 is lying flat on the sea floor, about half of the flukes 16 will dig in. The flukes 16 are solid bars, being rectangular in cross-section. One of the sides of each fluke 16 is undercut so that the opposite side tapers to a sharp edge for gripping purposes. The embodiment shown has the flukes 16 symetrically rotated in 90° increments around cylinder 12 with relatively small distances between flukes. However, various changes in the number, size and position of the flukes 16 are optional, dependent upon the requirements of the application on which the device is to be used.

Figure 2:
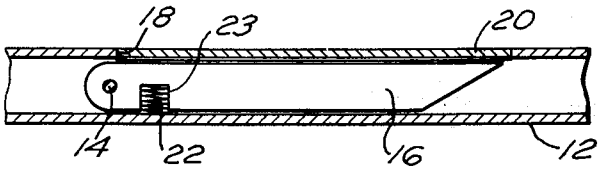
FIG. 2 shows a fluke of FIG. 1 in the retracted position.
Figure 3:
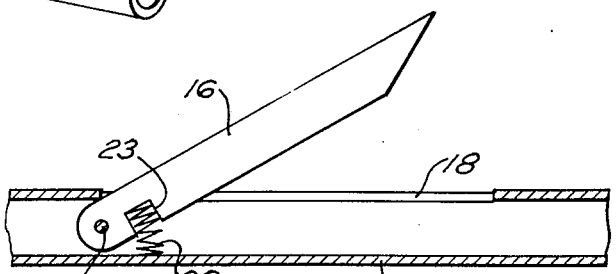
FIG. 3 shows a fluke of FIG. 1 in the extended position.

FIG. 2 shows a fluke 16 being held in the retracted position by means of a caked water-soluble material 20. Common suitable materials are sugar, salt, flour, etc. When the anchor enters the sea water this material 20 must be capable of quickly dissolving to release the fluke 16 which is then extended by a compressed spring 22 inserted in aperture 23. By the time the anchor 10 settles to the sea floor all of the flukes 16 will be extended and the anchor 10 operational. This extended position of fluke 16 is shown in FIG. 3.

Figure 4:
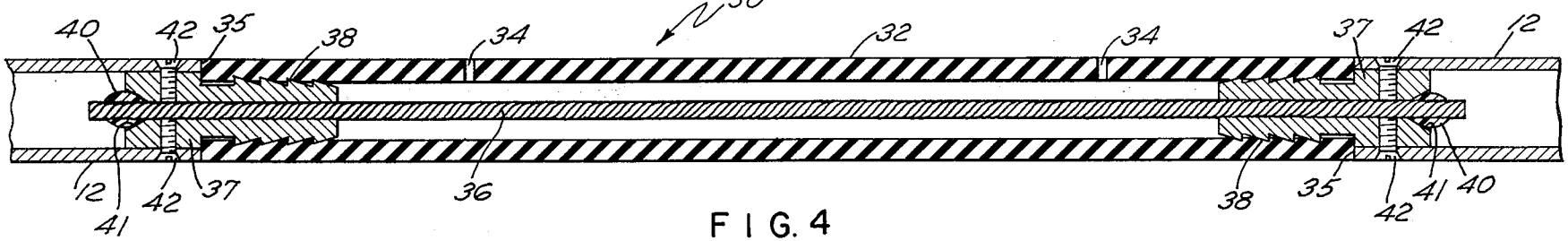
FIG. 4 shows a coupling for joining additional sections or components to the section of FIG. 1

The maximum length of the cylinder 12 is limited by what can be practically handled inside the submarine. Should this length not be able to accommodate enough flukes 16 to provide adequate anchoring restraint for a specific application, any number of lengths of the anchor can be ganged together by means of a flexible coupling 30, as shown in FIG. 4. This same coupling 30 can be used to join an anchor section 10 to the array (not shown).

The coupling 30 is an assembly comprising a reinforced heavy wall elastomeric hose 32 having vent holes 34 at both ends for sea water flooding. A center strength member 36 comprising a flexible wire rope is passed axially through the center opening in the elastomeric hose 32. The strength member 36 is of a length greater than hose 32 so that it extends into cylinder 12. The hose 32 and the cylinder 12 abut each other with both having an equal outer diameter. An end fitting 37 having a shoulder 35 and serrations 38 forms a linking member between hose 32 and cylinder 12. The strength member 36 passes through the center of fitting 35 in an axial direction and the member 36 is bonded by epoxy 40 at a beveled hole 41 at the back end of fitting 37. In addition, beveled holes are made in cylindrical tube 12 and the side of fitting 37 for the fastening of screws 42. The serrated portion 38 of fitting 37 can be epoxied to hose 32 for additional holding strength.

There has therefore been described a device that is deployable from inside a submarine which will provide adequate holding power to restrain an array on the ocean floor. The cylinder 12 is constructed of heavy mass rigid or semi-rigid material. In addition to the tubular type shown the cylinder 12 can be solid in material with cutouts provided for flukes 16. The diameter of the anchor with the flukes 16 in the retracted position is normally sized to fit existing submarine floating wire antenna stuffing tubes, but can be changed to fit other hull penetrating devices. It could conceivably be sized much larger for ejection through submarine torpedo or missile tubes. Length is optional, dependent upon requirements, and the anchor may comprise one or more sections 10 joined by flexible couplings 30. These couplings must have flexibility and strength, as well as constant diameter so that water leakage as the device is ejected is minimal. The coupling 30 could also be used as an end fitting to mate the anchor to an array, but this can be eliminated if the array is of adequate flexibility in itself. The anchor could conceivably contain a depth sensor, tension device, associated electrical conductors and/or other instrumentation.

It will be understood that various changes in the details, materials, steps and arrangement of parts, which have been herein described and illustrated in order to explain the nature of the invention, may be made by those skilled in the art within the principle and scope of the invention as expressed in the appended claims.

What is is claimed is:

1. An anchoring assembly comprising:

a plurality of anchoring devices wherein each of said anchoring devices comprises a cylindrical tubular housing, a plurality of flukes mounted to said cylindrical tubular housing so as to be capable of being held in both a retracted and an extended position, said retracted position being one in which no portion of said flukes extends beyond the radial limits of said housing, said extended position being one in which said flukes extend beyond the radial limits of said housing for gripping purposes, said flukes being axially spaced from each other along said housing and consecutive axially spaced flukes being radially spaced at a predetermined angle from each other, said flukes comprise a solid bar being rectangular in cross-section having one side undercut so that an end tapers to a sharp edge, a plurality of slots housing respective flukes in both said retracted and extended position and a plurality of hinging means for holding said respective flukes in either the retracted or extended position with respect to said housing, said hinging means comprises a rod mounting said respective fluke to said housing, a water soluble material placed for holding said fluke in said retracted position and a spring connected to said fluke, said spring being of such tension to be capable of moving said fluke from said retracted to said extended position upon the removal of said water soluble material; and a coupling assembly connecting said plurality of anchoring devices to each other, said coupling assembly comprises an elastomeric hose having an outer diameter equal to the outer diameter of said cylindrical tubular housing, an end of said elastomeric hose abutting a respective end of said cylindrical tubular housing, a center strength member extending through the center of said elastomeric hose and extending into said respective end of said cylindrical tubular housing, an end fitting extending into abutting ends of said cylindrical tubular housing and said elastomeric hose, said center strength member passing through said end fitting, said end fitting having a shoulder abutting said end of said elastomeric hose and a serrated extension extending into said elastomeric hose, fastening means connecting said cylindrical tubular housing to said end fitting and adhesive means connecting said center strength member to said end fitting.

* * * * *